US010906058B2

(12) United States Patent
Nelson et al.

(10) Patent No.: US 10,906,058 B2
(45) Date of Patent: Feb. 2, 2021

(54) SYSTEMS AND METHODS FOR INSPECTING AND CLEANING A NOZZLE OF A DISPENSER

(71) Applicant: NORDSON CORPORATION, Westlake, OH (US)

(72) Inventors: Ralph C. Nelson, Oceanside, CA (US); Jared Wilburn, San Marcos, CA (US); Alan R. Lewis, Carlsbad, CA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 15/871,977

(22) Filed: Jan. 15, 2018

(65) Prior Publication Data

US 2018/0214901 A1 Aug. 2, 2018

Related U.S. Application Data

(60) Provisional application No. 62/451,356, filed on Jan. 27, 2017.

(51) Int. Cl.
*B05B 15/522* (2018.01)
*B05B 15/52* (2018.01)
(Continued)

(52) U.S. Cl.
CPC ..... *B05B 15/522* (2018.02); *B05B 15/52* (2018.02); *B05C 21/00* (2013.01); *B08B 9/023* (2013.01); *B08B 13/00* (2013.01)

(58) Field of Classification Search
CPC ..... B05B 15/52; B05B 15/522; B05C 21/00; B08B 13/00; B08B 9/023
(Continued)

(56) References Cited

U.S. PATENT DOCUMENTS 1,491,608 A * 4/1924 Kaiser ..... A47L 13/50 15/142
2,202,215 A * 5/1940 Lutz ..... D01G 15/766 15/186
(Continued)

FOREIGN PATENT DOCUMENTS

DE 19936670 C1 2/2001
JP 05-138361 A 6/1993
(Continued)

OTHER PUBLICATIONS

Kojima (JP 2003188807A), Machine Translation (Year: 2019).*
European search report dated Jun 18, 2018 for EP Application No. 18153760.

*Primary Examiner* — Nadine G Norton
*Assistant Examiner* — Christopher Remavege
(74) *Attorney, Agent, or Firm* — Baker & Hostetler LLP

(57) ABSTRACT

Systems and methods for inspecting and cleaning a nozzle of a dispenser are disclosed. The systems may include a platform supporting a cleaning substrate. The cleaning substrate may have a plurality of hook structures configured to remove a material from the nozzle. The systems may also include a camera configured to capture an image of the nozzle and a controller configured to control the system. The methods may include providing a cleaning substrate having a plurality of hook structures, and moving at least one of the nozzle and the cleaning substrate relative to the other to remove a material from the nozzle. The methods may also include capturing an image of the nozzle after dispensing with a camera, processing the image to generate a value, utilizing the value to determine if the nozzle should be cleaned, and if the determination is that the nozzle should be cleaned, cleaning the nozzle.

34 Claims, 10 Drawing Sheets

(51) Int. Cl.
*B08B 9/023* (2006.01)
*B08B 13/00* (2006.01)
*B05C 21/00* (2006.01)

(58) Field of Classification Search
USPC ..... 15/3, 97.1, 104.93, 104.94; 134/6, 18; 347/33
See application file for complete search history.

(56) References Cited

U.S. PATENT DOCUMENTS 2,899,929 A 8/1959 Monroe
4,461,312 A * 7/1984 Gueret ..... A46B 1/00 132/218
4,627,126 A * 12/1986 Nichols ..... A47L 25/005 15/104.001
5,240,502 A 8/1993 Castaldo et al.
5,836,032 A * 11/1998 Hondo ..... E03C 1/30 15/104.32
5,845,357 A * 12/1998 Anderson ..... B08B 1/00 15/93.1
5,949,448 A * 9/1999 Man ..... B41J 2/16538 347/33
6,454,388 B1 * 9/2002 Bretl ..... B41J 2/16538 347/33
6,655,781 B2 * 12/2003 Nakagawa ..... B41J 2/16547 347/32
6,673,160 B2 * 1/2004 Stathem ..... B41J 2/16517 134/15
6,769,462 B2 8/2004 Larson et al.
7,629,043 B2 * 12/2009 Lindsay ..... A47L 13/16 428/316.6
8,905,516 B2 * 12/2014 Inoue ..... B41J 2/16535 347/33
8,925,765 B2 * 1/2015 Hanai ..... B65D 83/34 222/137
9,919,531 B2 * 3/2018 Mataki ..... B41J 29/38
10,478,849 B2 * 11/2019 Yuan ..... B08B 9/043
2002/0050016 A1 * 5/2002 Willman ..... A47L 13/16 15/104.002
2004/0263602 A1 * 12/2004 Nakashima ..... B41J 2/16585 347/104
2005/0225593 A1 * 10/2005 Ito ..... B41J 2/16538 347/33
2006/0010627 A1 * 1/2006 Godfroid ..... A47L 11/33 15/104.8
2007/0107155 A1 * 5/2007 Kacher ..... A47L 13/16 15/209.1
2008/0296311 A1 * 12/2008 Read ..... H05K 13/0469 221/1
2010/0309251 A1 * 12/2010 Cramm ..... B41J 2/16535 347/33
2015/0132480 A1 * 5/2015 Daum ..... B05C 5/025 427/207.1
2019/0293671 A1 * 9/2019 Barbero-Ortega ..... G01N 35/1002
2019/0321848 A1 * 10/2019 Wen ..... B08B 1/02

FOREIGN PATENT DOCUMENTS

JP 2004188807 A * 7/2004
WO 2003/084653 A1 10/2003
WO 2005/090038 A2 9/2005

* cited by examiner

SYSTEMS AND METHODS FOR INSPECTING AND CLEANING A NOZZLE OF A DISPENSER

RELATED APPLICATION

The present disclosure claims priority to U.S. Provisional Patent Application No. 62/451,356, filed on Jan. 27, 2017, the entire disclosure of which is incorporated herein by reference.

TECHNICAL FIELD

The present disclosure relates generally to systems and methods for treating a nozzle of a dispenser, and more particularly, to systems and methods for inspecting and cleaning a dispensing nozzle with a cleaning substrate having a plurality of hook structures.

BACKGROUND

Dispensing processes of jetting technology can become ineffective due to excessive accumulation of material on an exterior surface of a nozzle. Excessive accumulation can hinder the dispensing of fluid or viscous material and/or truncate the lifecycle of the dispensing equipment. Maintenance often requires the operator to periodically pause the production cycle and manually inspect multiple nozzles to ensure that excessive accumulation has not occurred. However, manual inspection and cleaning can be difficult because of the small size of the nozzles, the nozzles are typically not visible without use of a mirror, and the operator is often responsible for multiple dispensing machines.

Furthermore, the cleaning substrates currently applied to cleaning dispensers are often ineffective. For example, fabrics and sponges do not provide sufficient scrubbing and lack durability due to the fluid or viscous materials quickly clogging their pores. Fabrics and sponges can also shed which is not suitable for a clean room environment. Brushes are another potential cleaning substrate, but have similar problems in addition to being too abrasive, potentially damaging the nozzles. Therefore, there is a need for cleaning dispensing nozzles more effectively in an automated manner.

SUMMARY

The foregoing needs are met, to a great extent, by the systems and methods described herein. In one aspect, a system for cleaning a nozzle of a dispenser may include a platform and a cleaning substrate supported by the platform. The cleaning substrate may have a plurality of hook structures configured to remove a material from the nozzle.

Another aspect is directed to a method of cleaning a nozzle of a dispenser. The method may include providing a cleaning substrate having a plurality of hook structures, and moving at least one of the nozzle and the cleaning substrate relative to the other to remove a material from the nozzle.

Yet another aspect is directed to a method of inspecting a nozzle of a dispenser. The method may include dispensing a fluid or viscous material with the nozzle, and capturing an image, with a camera, of the nozzle after dispensing. The method may also include processing the image to generate a value based on a pixel intensity of the image, and utilizing the value to determine if the nozzle should be cleaned. The method may further include cleaning the nozzle based on the determination that the nozzle should be cleaned.

Still a further aspect is directed to a dispensing system including a platform and a nozzle of a dispenser moveable relative to the platform. The dispensing system may include a camera positioned underneath the platform and configured to capture an image of the nozzle, and a cleaning substrate supported by the platform and having a plurality of hook structure. The system may further include a controller configured to generate one or more signals to dispense a fluid or viscous material from the nozzle, and actuate the camera to capture an image of the nozzle. The one or more signals may process the image to generate a value, and utilize the value to determine if the nozzle should be cleaned. The one or more signals may further move at least one of the nozzle and the cleaning substrate relative to the other to remove at least some of the fluid or viscous material from the nozzle with the hook structures in response to a determination that the nozzle should be cleaned.

BRIEF DESCRIPTION OF THE DRAWINGS

In order that the disclosure may be readily understood, aspects of this disclosure are illustrated by way of examples in the accompanying drawings.

The same reference numbers reference the same parts in the drawings and the detailed description.

DETAILED DESCRIPTION

Systems and methods for inspecting and cleaning at least one dispensing nozzle are described. The system includes a platform supporting a cleaning substrate having a plurality of hook structures configured to remove a material from the nozzle of the dispenser. The hook structures may comprise the hook portion of, for example, a Velcro or DuraGrip branded fastener. The hook structures may provide a number of benefits over fabrics, clothes, and brushes used as cleaning substrates, such as durability, a gentle scrubbing on the nozzle, minimal or no shedding, and/or a favorable configuration for trapping and retaining the material removed from the nozzle. Furthermore, material with hook structures are readily available in various sizes, density, and hook shapes to optimize cleaning with various nozzle structures and materials. In some embodiments, two or more of the dispensing nozzles may be secured to a common head and may be cleaned with the cleaning substrate at the same time or separately. For example, the dispensing nozzles may be moveable relative to each other along a z-axis to be separately wiped against the cleaning substrate.

In some embodiments, the cleaning substrate may be dry, and in some embodiments, the cleaning substrate may be positioned in a container and at least partially submerged (or covered) in a cleaning solvent. A drying substrate may, therefore, be provided to remove the cleaning solvent from the nozzle after the nozzle has been submerged in the cleaning solution. A camera may be positioned underneath the platform to capture an image of the nozzle. A controller may be configured to process the image to generate a value based on the amount of material coated on the nozzle. The nozzle may be moved relative to the cleaning substrate to wipe the nozzle, or vice versa. The movement of the nozzle and/or cleaning substrate may include at least of one of a linear pattern, a zigzag pattern, a rectangular pattern, a square pattern, an oval pattern, and a circular pattern.

Figure 1:
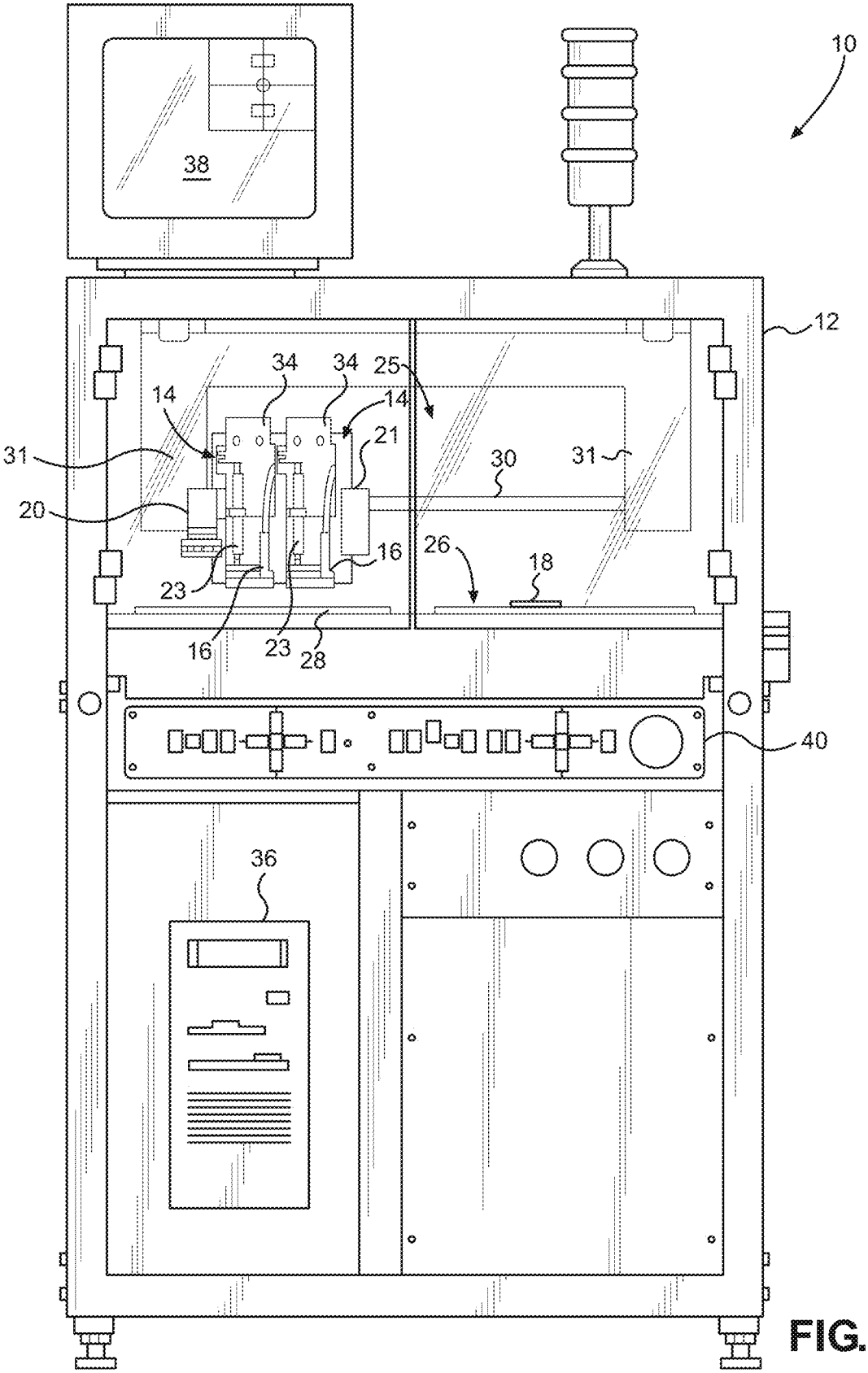
FIG. 1 illustrates an exemplary dispensing system.

FIG. 1 illustrates an exemplary dispensing system 10 including a cabinet 12 and one or more dispensing assemblies 14. Each of the dispensing assemblies 14 may include a dispensing nozzle 16 having a valve (depicted m FIGS. 9A-C) for selectively dispensing controlled amounts of fluid or viscous material onto a substrate 18 (e.g., a circuit board) positioned on a working area 26 of the cabinet 12. The dispensing assembly 14 may also include a camera 20 and a height sensor 21. The dispensing nozzle 16 may be a needle dispenser, a spray dispenser, a jetting dispenser, or any other device suitable for dispensing fluid or viscous materials such as adhesives, epoxies, or solder pastes onto the substrate 18 from a fluid material reservoir 23.

As illustrated, the dispensing systems 10 may include first and second dispensing assemblies 14 for dispensing material onto either a single substrate or separate substrates. Each of the dispensing assemblies 14 may be coupled to a positioner 25 configured to selectively position the dispensing assemblies 14 above the working area 26 and/or a service station 28 of the cabinet 12. The positioner 25 may include one or more cross supporting structures 30, each supporting one or more dispensing assemblies 14 and extending between opposite side supporting structures 31. The dispensing assemblies 14 may move in an x-direction along the cross supporting structure 30 through common or separate motorized assemblies (not shown). The cross supporting structure 30 may move the dispensing assemblies 14 in a y-direction relative to the side supporting structures 31 via rolling assemblies powered by linear motors (not shown). The positioner 25 may also include a z-axis drive 34 configured to move one or more of the dispensing assemblies 14 in a z-direction to adjust the height of the dispensing assembly 14 and/or dispensing nozzle 16 relative to the working area 26 and/or the service station 28. The positioner 25 may thereby provide three substantially perpendicular axes of motion for the dispensing assembly 14. For example, a pair of dispensing assemblies 14 may be positioned on a common head and be moved together in the x- and y-directions, while having separate z-axis drives 34. Therefore, the dispensing assemblies may dispense two different materials on a single substrate, such that one of the dispensing assemblies 14 may be toggled (or lifted in the z-direction out of the way) while the other of the dispensing assemblies is in use. In another example, the pair of dispensing assemblies 14 may simultaneously dispense the same material on a substrate to speed up production. The positioner 25 may adjust the relative positioning between the pair of dispensing assemblies 14 to accommodate skewed substrates along the x-, y-, and/or z-axes. In another example, the pair of dispensing assemblies 14 may be moved independently in the x- and y-directions, but moved simultaneously in the z-direction along the x-, y-, and/or z-axes. In yet another example, the dispensing assemblies may be moved completely independently.

The dispensing system 10 may also include a controller 36, which may be a computer mounted in the cabinet 12. The controller 36 may be configured to provide overall control of the dispensing system 10, such as coordinating movements of the dispensing assembly 14, actuating the dispensing nozzle 16, and/or actuating components of the service station 28. The controller 36 may include a processor, a memory, and an input/output (I/O) interface. The processor may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on operational instructions that are stored in the memory. The memory may be a single memory device or a plurality of memory devices including but not limited to read-only memory (ROM), random access memory (RAM), volatile memory, non-volatile memory, static random access memory (SRAM), dynamic random access memory (DRAM), flash memory, cache memory, or any other device capable of storing digital information. The memory may also include a mass storage device (not shown) such as a hard drive, optical drive, tape drive, non-volatile solid state device or any other device capable of storing digital information. The processor may operate under the control of an operating system that resides in memory. The operating system may manage controller resources so that computer program code embodied as one or more computer software applications.

A user interface 38 and/or a control panel 40 may be operatively coupled to the controller 36 to allow a system operator to interact with the controller 36. The user interface 38 may include a video monitor, alphanumeric displays, a touch screen, a speaker, and any other suitable audio and/or visual indicators capable of providing information to the system operator. The control panel 40 may include one or more input devices capable of accepting commands or input from the operator, such as an alphanumeric keyboard, a pointing device, keypads, pushbuttons, control knobs, microphones. In this way, the user interface 38 and/or the control panel 40 may enable manual initiation of system functions, for example, during set-up, calibration, inspection, and/or cleaning.

Figure 2:
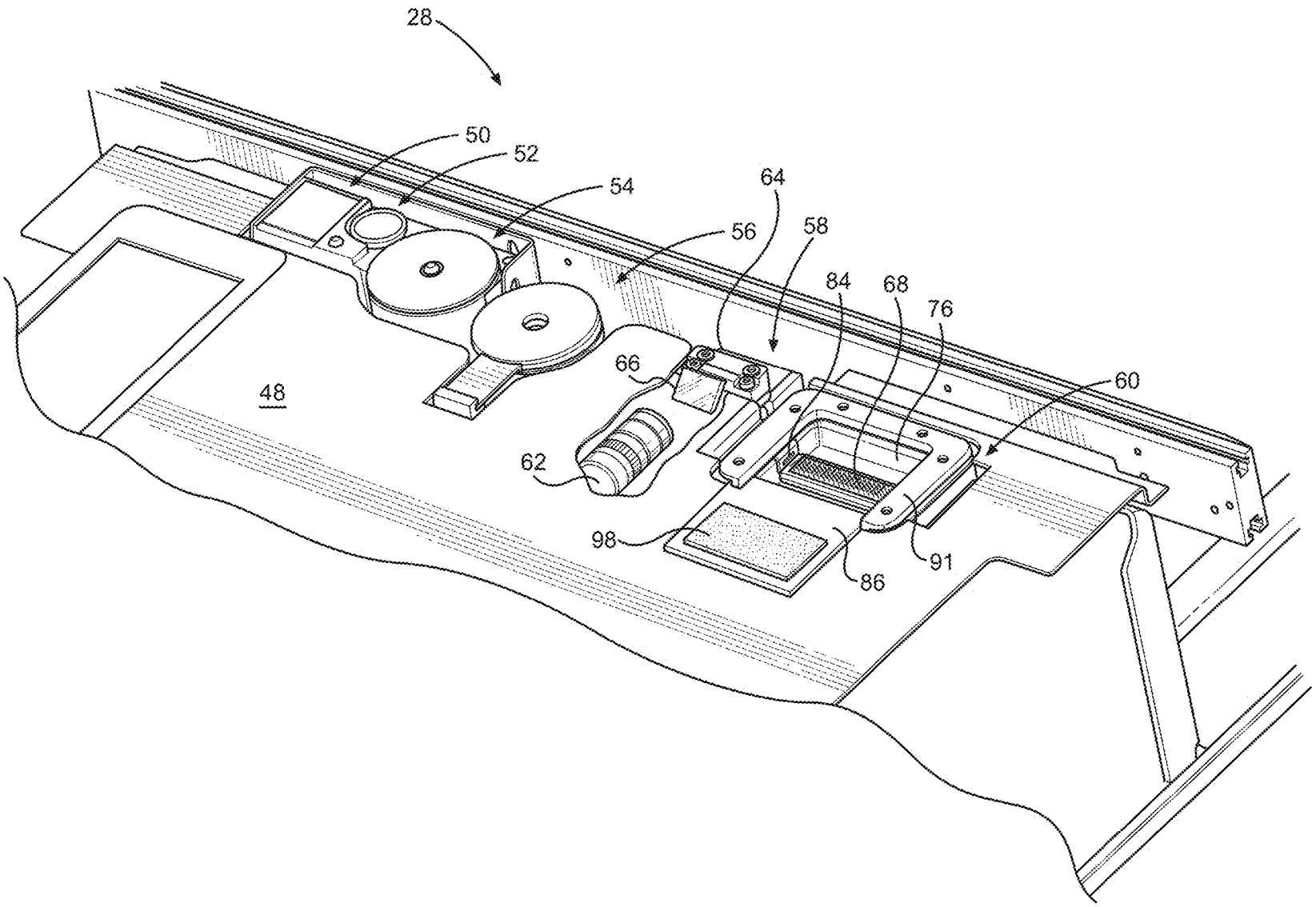
FIG. 2 illustrates an exemplary service system of the dispensing system of FIG. 1.

FIG. 2 illustrates an exemplary service station 28 configured to inspect and clean a nozzle of the dispensing nozzle 16. As shown, the service station 28 may include a platform 48 supporting one or more of a calibration station 50, a touch sensor station 52, a purge station 54, a weighing station 56, an inspection station 58, and a cleaning station 60.

The calibration station 50 may be configured to calibrate the x/y-position of the dispensing nozzle 16. For example, the calibration station 50 may provide a fixed reference point that can be captured by the camera 20 and/or the height sensor 21, which generates a signal to the controller 36. The controller 36 may then calibrate the x/y-position of the camera and/or the height sensor 21 based on the signal.

The touch sensor station 52 may be configured to calibrate the z-position of the dispensing nozzle. For example, the dispensing nozzle 16 may be lowered toward the touch sensor station 52 until contact is initially sensed by a pressure sensitive region of the touch sensor station 52. Based on the initial contact by the dispensing nozzle 16, a signal is generated by the touch sensor station 52 and transmitted to the controller 36. The controller 36 may then calibrate the z-position of the dispensing nozzle 16.

The purge station 54 may be configured to remove waste material from the dispensing nozzle 16. For example, the purge station 54 include a source of vacuum configured to generate negative pressure to suck the fluid or viscous material and/or cleaning material from a surface of the dispensing nozzle. The vacuumed material may be deposited in a reservoir (not shown) positioned underneath the platform 48.

The weighing station 56 may be configured to calibrate the material of the dispensing system 10. For example, the weighing station 56 may include a scale configured to receive and weigh one or more droplets from the dispenser. The scale may then generate a signal indicative of the weight, which is transmitted to the controller 36. Based on the weight of the material, the controller 36 may calibrate the material deposited by the dispensing nozzle 16.

Figure 9A:
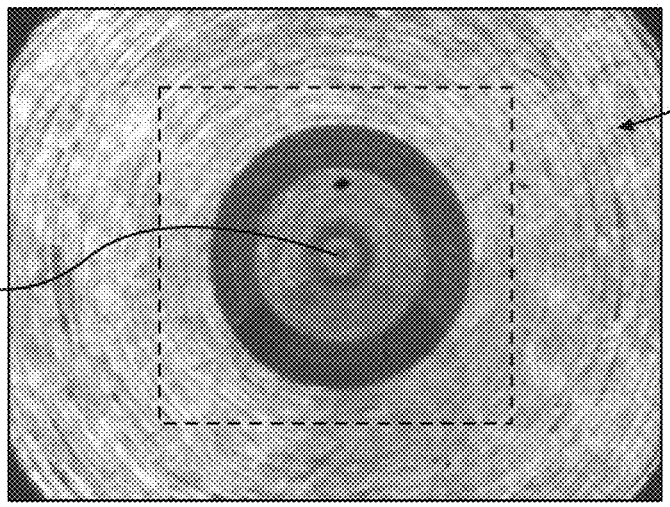
FIGS. 9A-C illustrate exemplary images captured of the dispensing nozzle of FIGS. 5A-C.
Figure 9B:
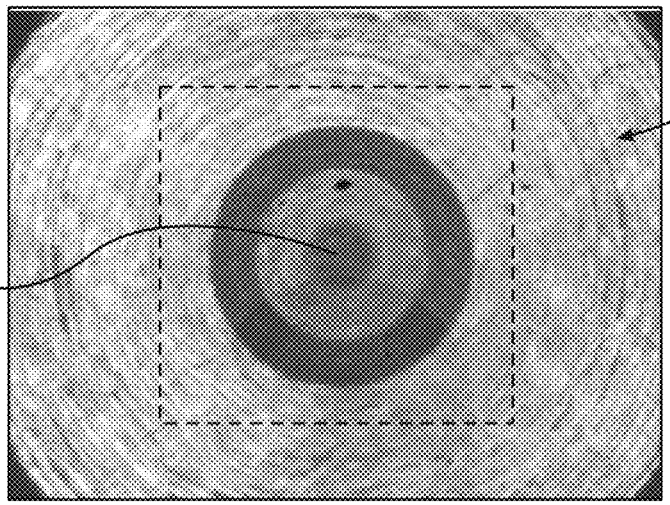
Figure 9C:
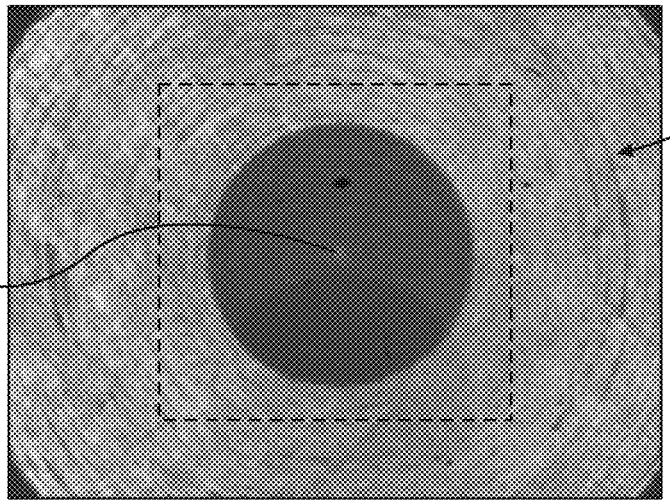

The inspection station 58 may be configured to inspect the dispensing nozzle 16 to detect accumulation of material on the dispensing nozzle 16. As shown in FIG. 2, the inspection station 58 may include a camera 62, an angled mirror 64, and a transparent cover 66. The camera 62 may be positioned substantially horizontal and underneath the platform 48. The angled mirror 64 may be positioned underneath the transparent cover 66 and aligned with the camera 62, such that the angled mirror 64 may be configured to reflect a vertical image of the dispensing nozzle 16 horizontally to the camera 62 (as depicted in FIGS. 9A-C). The transparent cover 66 may protect the angled mirror 64 from any fluid or viscous material that might drip from nozzle 16. The transparent cover 66 may be easier to clean and/or replace than the angled mirror 64. The camera 62 being positioned substantially horizontally within the service station 28 may reduce the required thickness of the dispensing system 10. However, it is also contemplated that the camera 62 may be positioned substantially vertically within the service station 28, thereby obviating the need for the angled mirror 64. In either case, the camera 62 may capture an image of an opening of the dispensing nozzle 16 and transmit the image to the controller 36. The controller 36 may process the image to determine an amount of material accumulated on the dispensing nozzle 16. For example, in some embodiments, the camera 62 may capture the image in greyscale, and the controller 36 may process the image to generate a value indicating a pixel intensity of the image, as further discussed below.

Figure 3:
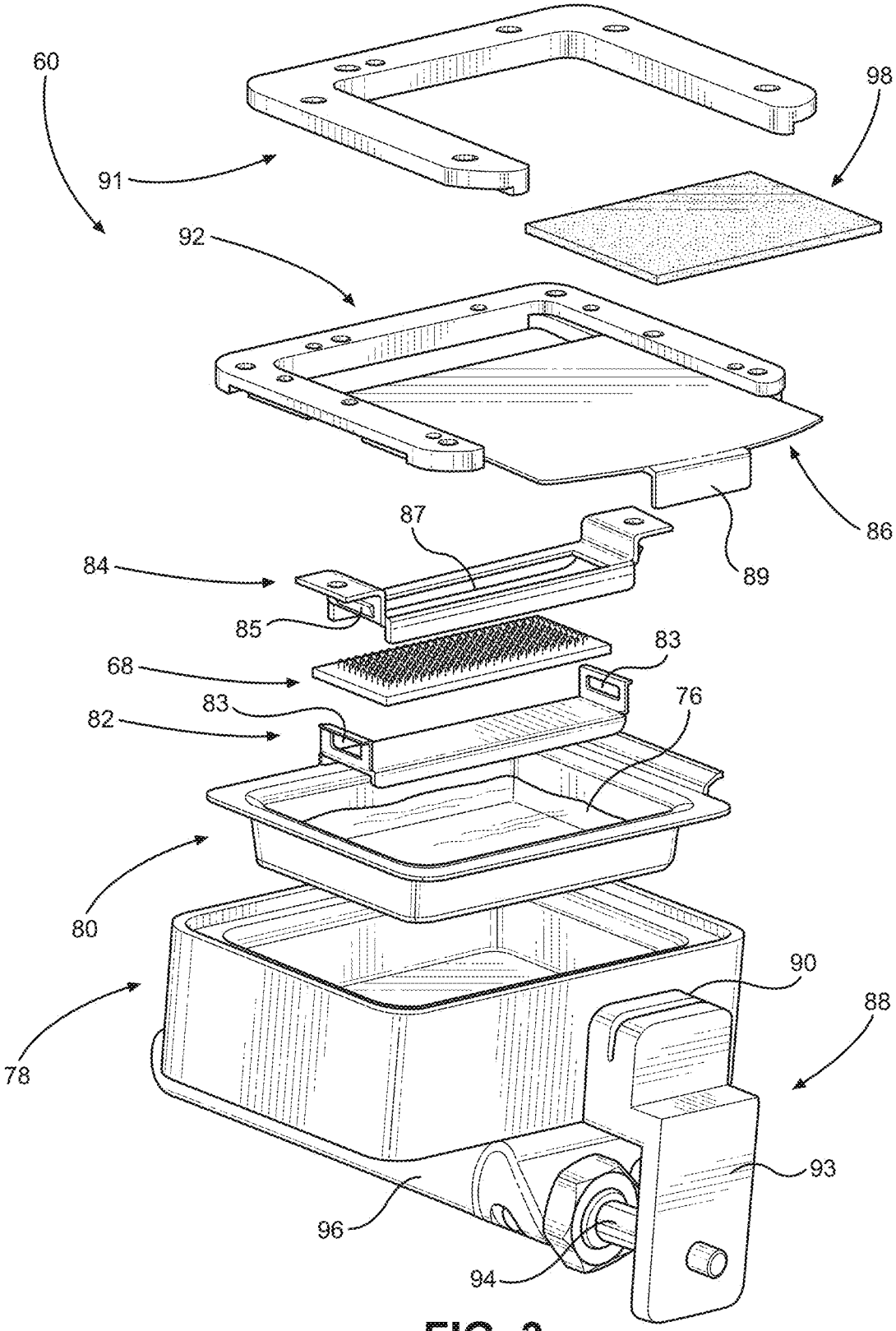
FIG. 3 illustrates a first exemplary cleaning station of the service station of FIG. 2.
Figure 4:
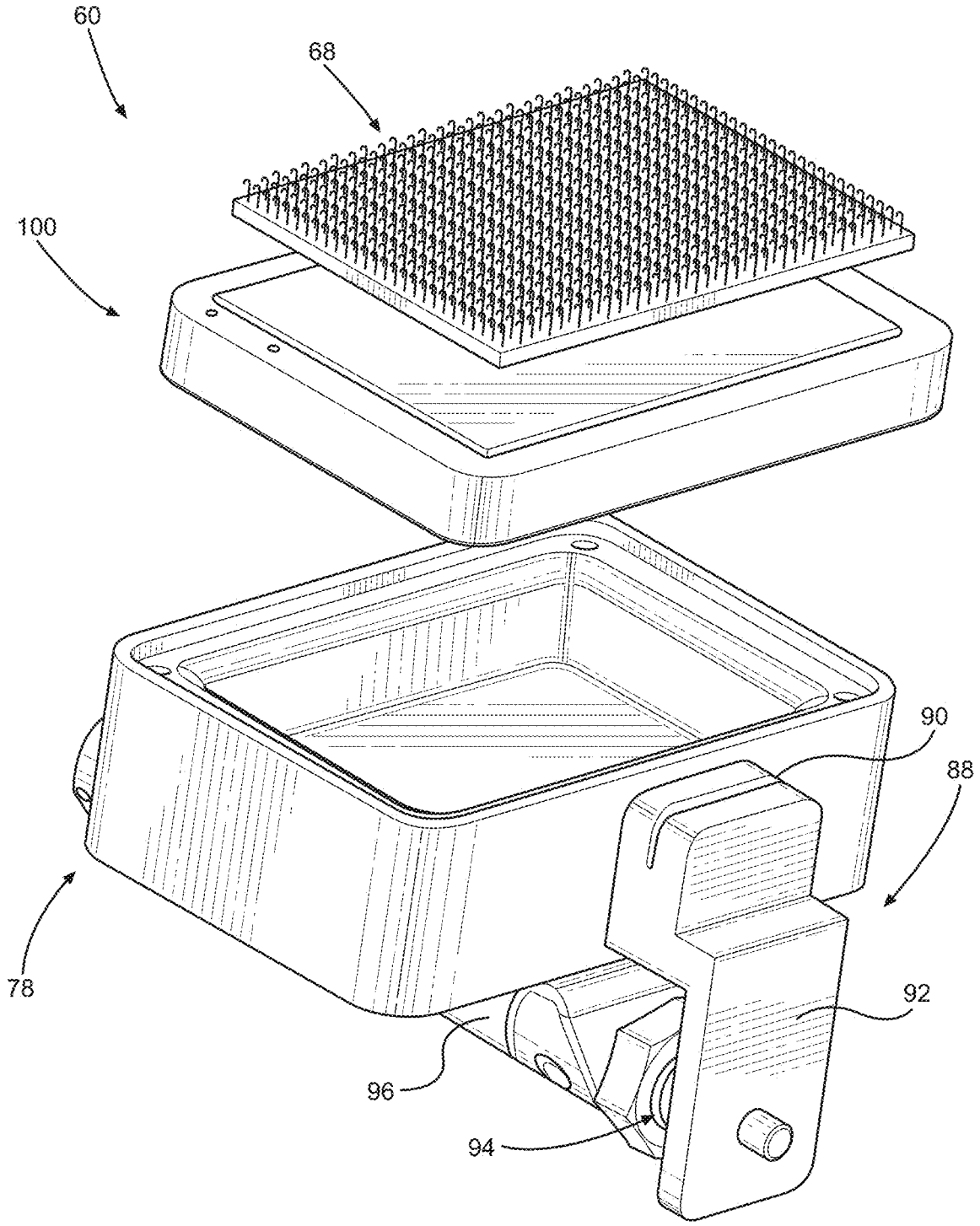
FIG. 4 illustrates a second exemplary cleaning station of the service station of FIG. 2.
Figure 5C:
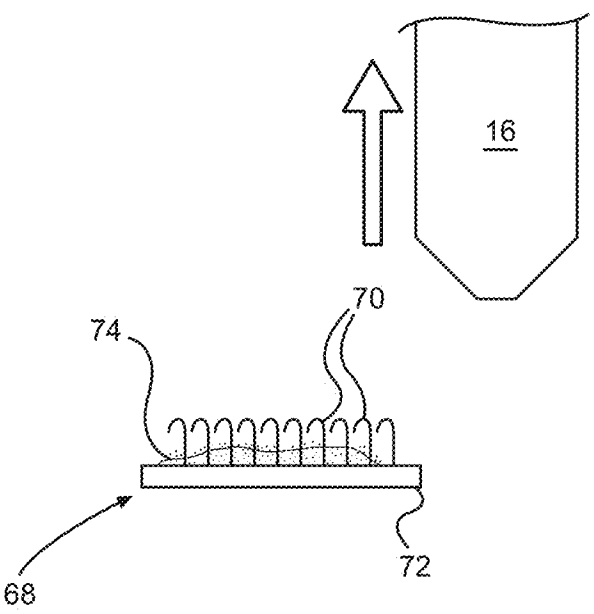
FIGS. 5A-C illustrate an exemplary method of cleaning a dispensing nozzle with the service station of FIG. 2.
Figure 5B:
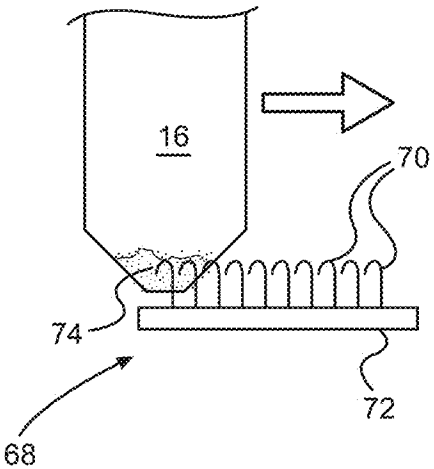
Figure 5A:
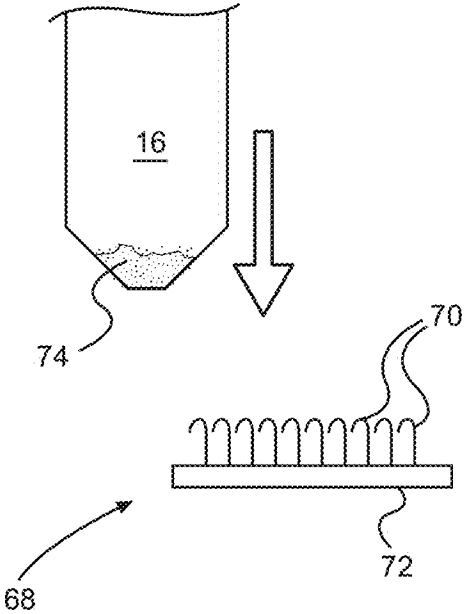

The cleaning station 60 may be configured remove material from a surface of the dispensing nozzle 16. As depicted in FIGS. 2-5, the cleaning station 60 may include a cleaning substrate 68 configured to remove material from an exterior surface of the dispensing nozzle 16. The cleaning substrate 68 may include a plurality of hook structures 70 supported by a backing 72 and configured to wipe a material 74 from an exterior surface of the dispensing nozzle 16 (as depicted in FIG. 5A-5C). In some embodiments, the cleaning substrate 68 may comprise the hook portion of a Velcro or DuraGrip branded fastener. For example, the hook structures 70 may comprise a substantially rigid and durable material, such as nylon or polyester, configured to gently scrub the dispensing nozzle 16, and trap the material 74 between the hook structures 70 and the backing 72. In some embodiments, the cleaning station 60 may have the cleaning substrate 68 in a wet configuration at least partially submersed or covered in a cleaning solvent 76 (as depicted in FIGS. 2-3). In other embodiments, the cleaning station 60 may have the cleaning substrate 68 in a dry configuration (as depicted in FIG. 4).

Referring to FIGS. 2-3, the cleaning station 60 may include a base 78 configured to support a container 80 containing the cleaning solvent 76. The cleaning station 60 may also include a lower substrate housing 82 and an upper substrate housing 84 configured to releasably secure the cleaning substrate 68 sandwiched therein. The upper substrate housing 84 may include a tab 85 on each end configured to snap into a slot 83 on each end of the lower substrate housing 82. However, other releasable mechanisms may be utilized to allow removal and/or cleaning of the cleaning substrate 68. The upper substrate housing 84 may also include an opening 87 through which the hook structures 70 extends to expose the hook structures 70 for wiping against the dispensing nozzle 16. The cleaning substrate 68 may also include a border without the hook structures 70, which may be clamped between the upper substrate housing 84 and the lower substrate housing 82.

The cleaning station 60 may further include a lid 86 slideably secured between an upper lid housing 91 and a lower lid housing 92. The lid 86 may be opened and closed with a lid actuator 88. For example, the lid 86 may include a protrusion 89 received within a slot 90 of an actuator arm 93. The actuator arm 93 may be secured to a piston rod 94 configured to extend and retract in/out of a chamber 96 to open and close the lid 86 with respect to the container 80. The lid 86 may enclose the container 80 to reduce evaporation of the cleaning solvent 76, when the cleaning substrate 68 is not in use. The upper lid housing 91 and the lower lid housing 92 may be secured with fasteners, such as screws or rivets. The cleaning station 60 may include a releasable assembling mechanism to releasably assemble the cleaning station 60, such as a first magnet included in or on the base 78 and a second magnet included in or on the lower lid housing 92. The magnetic assembly of the cleaning station may facilitate removing, cleaning, and/or replacing the cleaning substrate 68 and/or the cleaning solvent 76.

The hook structures 70 may be partially or fully submerged (or covered) in the cleaning solvent 76. The cleaning solvent 76 may be an alcohol- or water-based solvent configured to remove and/or dissolve the material 74 while the dispensing nozzle 16 is wiped against the cleaning substrate 68. Simple Green All-Purpose Cleaner (which may contain ethoxylated alcohol) is an especially effective cleaning solvent 76 for a clean-room environment because of the non-toxic nature.

The cleaning station 60 may further include a level control system (not shown) configured to maintain a predetermined amount of the cleaning solvent 76. The level control system may include a level sensor, a filling device, and a reservoir containing the cleaning solvent 76 (not shown). The level sensor may include a number of different mechanisms configured to detect the level of the cleaning solvent 76, such as a float sensor, a hydrostatic sensor, a laser sensor, magnetic sensor, a capacitance sensor, and an ultrasonic sensor. The level sensor may generate a signal indicative of a level of the cleaning solvent 76 to the controller 36. The controller 36 may compare the level of the cleaning solvent 76 to a predetermined threshold. The controller 36 may then generate a signal to the filling device to add cleaning solvent 76 to the container 80 based on the detected level. Accordingly, the filling device may include a valve configured to selectively enable a flow of the cleaning solvent 76 to the container 80.

Following cleaning in the cleaning solvent 76, the dispensing nozzle 16 may be dried with a drying substrate 98. The drying substrate 98 may include a fabric or a sponge configured to remove the cleaning solvent 76 when placed in contact with the dispensing nozzle 16. The drying substrate 98 may be positioned in a number of different positions on or around the service station 28. For example, the drying substrate 98 may be positioned on an outer surface of the lid 86 to minimize required movement of the dispensing nozzle 16 during the cleaning and drying. When the lid 86 is closed, the drying substrate 98 may substantially overly the cleaning substrate 68 in the z-direction. Therefore, minimal or no x-y movement of the dispensing nozzle 16 would be required to put the dispensing nozzle 16 in contact with drying substrate 98 after the dispensing nozzle 16 is removed from the cleaning solvent 76. However, it is contemplated that the drying substrate 98 may be positioned in other locations, such as directly on the platform 48.

As depicted in FIG. 4, in some embodiments, the cleaning station 60 may have the cleaning substrate 68 in a dry configuration. The cleaning substrate 68 may be secured to a cleaning substrate support 100 releasably secured to the base 78. For example, the substrate housing 82, 84 and the cleaning substrate support 100 may be interchangeable to the cleaning station 60 to allow for changing between the wet configuration and the dry configuration of the cleaning substrate 68 based on dispensing conditions. For example, the cleaning substrate support 100 may also include a releasable assembling mechanism, such as a magnet configured to be releasably secured to the base 78 allowing for quick interchangeable assembly.

The dispensing system 10 may include a plurality of service stations 28, and/or the service station 28 may include a plurality of one or more of its components. For example, in embodiments having a plurality of dispensing nozzles 16, the service station 28 may include a plurality of cameras 62 and/or mirrors 64 for independent inspection of the plurality of dispensing nozzles 16. Similarly, in some embodiments, the service station 28 may include a plurality of cleaning substrates 68 for independent cleaning of the plurality of dispensing nozzles 16. In some embodiments, the plurality of dispensing nozzles 16 may be cleaned and/or inspected by separate service stations 28.

FIGS. 5A-C illustrate an exemplary method of cleaning the dispensing nozzle 16 with the cleaning substrate 68. As depicted in FIG. 5A, the dispensing nozzle 16 is covered with a material 74 and may be advanced along the z-axis, with the positioner 25, toward the cleaning substrate 68. The dispensing nozzle 16 is moved, with the positioner 25, laterally along the hook structures 70 to remove the material 74 from the surface of the dispensing nozzle 16. The material 74 is then retained and trapped between the hook structures 70 and the backing 72 of the cleaning substrate 68. As depicted in FIG. 5C, the dispensing nozzle is retracted along the z-axis away from the cleaning substrate 68 following cleaning. In embodiments having a plurality of dispensing nozzles 16, the dispensing nozzles 16 may be cleaned at the same time or separately. For example, when wiped separately, FIG. 5A may indicate the movement of a first dispensing nozzle 16 toward the cleaning substrate 68 along the z-axis and relative to (e.g., away from) a second dispensing nozzle 16. FIG. 5B may then indicate the movement of the first dispensing nozzle 16 together with or separately from the second dispensing nozzle 16. FIG. 5C may then indicate movement of the first dispensing nozzle 16 away from the cleaning substrate along the z-axis and relative to (toward) the second dispensing nozzle 16. When wiped together, the first and second nozzles 16 may be jointly moved toward the cleaning substrate 68 (as illustrated in FIG. 5A) and jointly moved away from the cleaning substrate 68 (as illustrated in FIG. 5C).

Figure 6A:
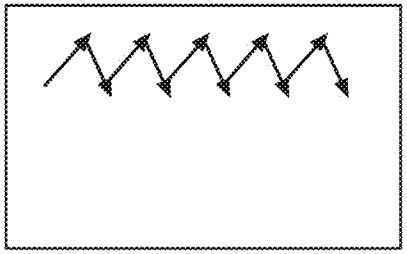
FIGS. 6A-D illustrate additional aspects of the exemplary method of cleaning the dispensing nozzle of FIGS. 5A-C.
Figure 6B:
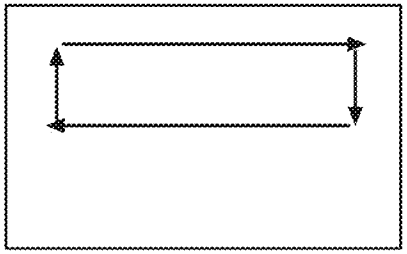
Figure 6C:
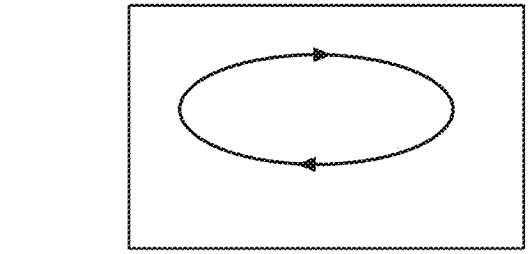

FIGS. 6A-D illustrate additional aspects of the exemplary method of cleaning the dispensing nozzle of FIGS. 5A-C. As illustrated in FIGS. 6A-C, the controller 36 (or a user) may move the dispensing nozzle 16 relative to the cleaning substrate 68 in multiple different directions in the x-y plane to wipe the dispensing nozzle 16. The controller 36 (or a user) may move or wipe the dispensing nozzle 16 relative to the cleaning substrate 68 in a first direction, and the controller 36 may then move or wipe the dispensing nozzle relative to the cleaning substrate 68 in a second direction different from the first direction, and so forth. For example, as depicted in FIG. 6A, the dispensing nozzle 16 may be moved or wiped in a first diagonal direction and a second diagonal direction. In some embodiments, the first and/or second diagonal directions are repeated with any number of repetitions, as exemplified by the zigzag movement illustrated in FIG. 6A. In some embodiments, the first and second directions may have rounded transitions, for example, forming a sinusoidal pattern along the cleaning substrate 68 (not shown). As depicted in FIG. 6B, the dispensing nozzle 16 may be moved or wiped in a first horizontal direction, a second vertical direction, a third horizontal direction, and a fourth horizontal direction, as exemplified by the rectangular movement. It is also contemplated that the horizontal and vertical directions of FIG. 6B may be equal forming a square movement. As depicted in FIG. 6C, the dispensing nozzle 16 may be moved or wiped in multiple directions to form an oval movement, but it is further contemplated that the major and minor axes of FIG. 6C may be the same to form a circular movement.

Figure 6D:
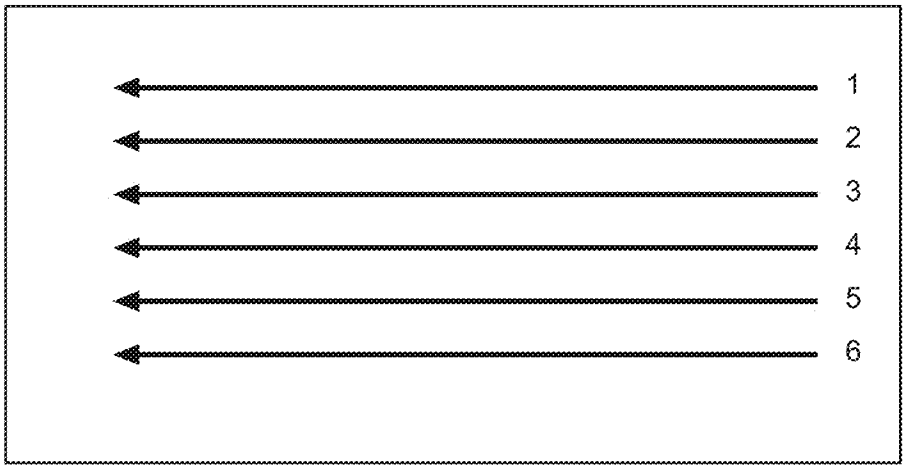

As illustrated in FIG. 6D, the dispensing nozzle 16 may be moved, with the positioner 25 and/or a user, relative to first and second portions of the cleaning substrate 68 according to an indexing method. For example, the dispensing nozzle 16 may be moved against a first portion of the cleaning substrate 68, and then indexed. The dispensing nozzle 16 may then be wiped against a second portion of the cleaning substrate 68, and then indexed. The indexing method may be repeated for a number of different portions of the cleaning substrate (e.g., six portions depicted in FIG. 6D). The indexing may indicate the number of wipes of the cleaning substrate 68 and/or the total number of wipes for each portion of the cleaning substrate 68. After wiping each portion or wiping all of the portions, the controller 36 may determine whether the number of wipes for the cleaning substrate 68 is greater than (or equal to) a predetermined total number that indicates the end of the lifecycle of the cleaning substrate 68 and/or the portion of the cleaning substrate 68. If the controller 36 determines the number of wipes is less than (or equal to) the predetermined total number of wipes, the controller 36 may determine that the cleaning substrate 68 and/or portion thereof is within the lifecycle and/or may continue to use the cleaning substrate 68 and/or portion thereof. However, if the controller 36 determines that the number of wipes is greater than (or equal to) the predetermined total number of wipes, the controller 36 may determine the end of the lifecycle of the cleaning substrate 68 and/or portion thereof. The controller 36 may, additionally, generate an audio and/or visual indication, as further discussed below.

Wiping the dispensing nozzle 16 on different portions of the cleaning substrate 68 creates a more uniform and distributed build-up on the cleaning substrate 68, increasing the overall lifecycle of the cleaning substrate 68. The indexing method also allows an operator to quantitatively monitor the lifecycle of the cleaning substrate and/or automate the lifecycle in a favorable manner. As shown in FIG. 6D, the indexing method may include linear wipes, but it is also contemplated that the indexing method may include other types of movements, such as those discussed in connection with FIGS. 6A-C.

Figure 7:
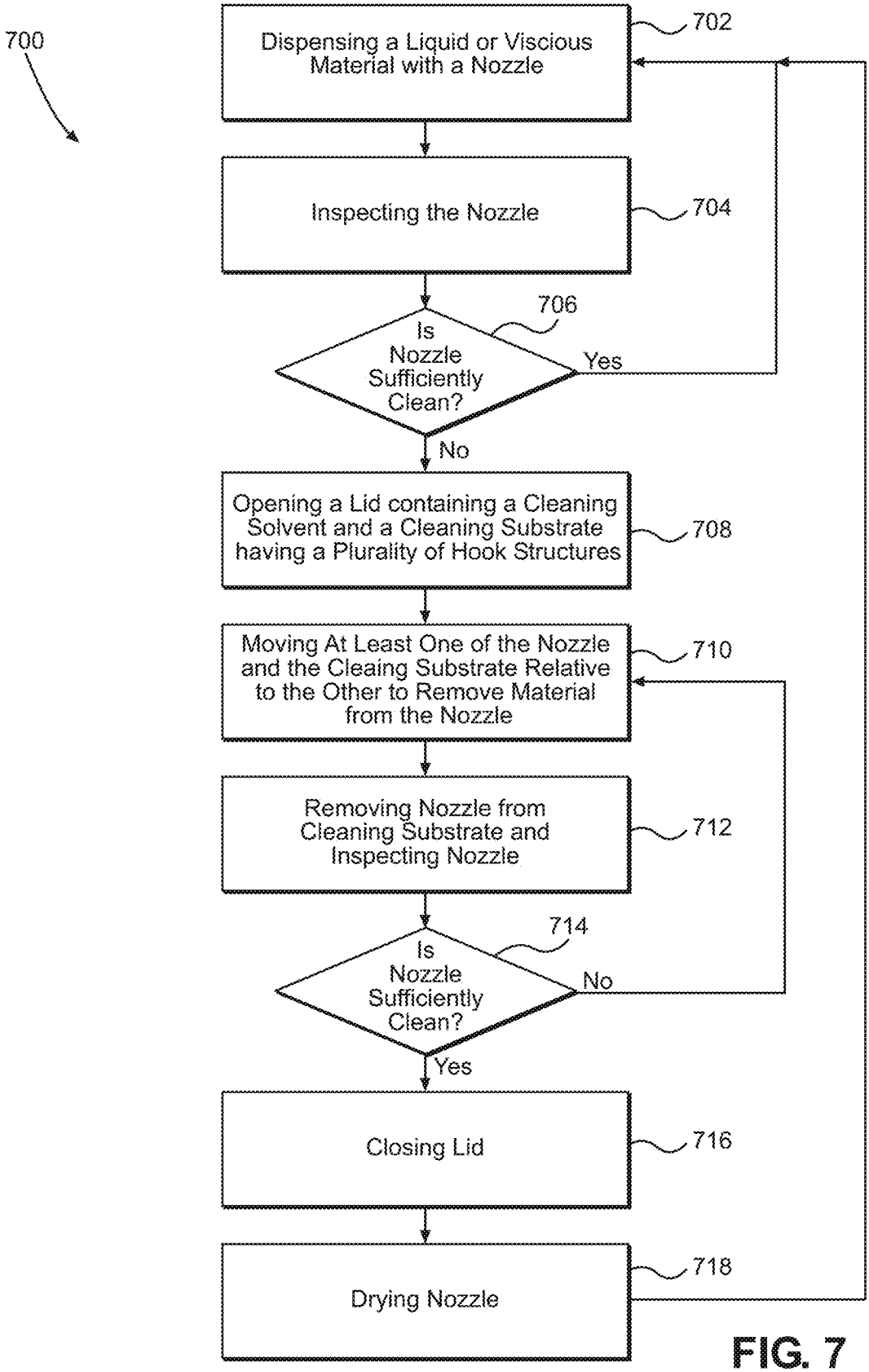
FIG. 7 provides an exemplary flow chart depicting a first method of cleaning a nozzle of a dispenser.
Figure 10:
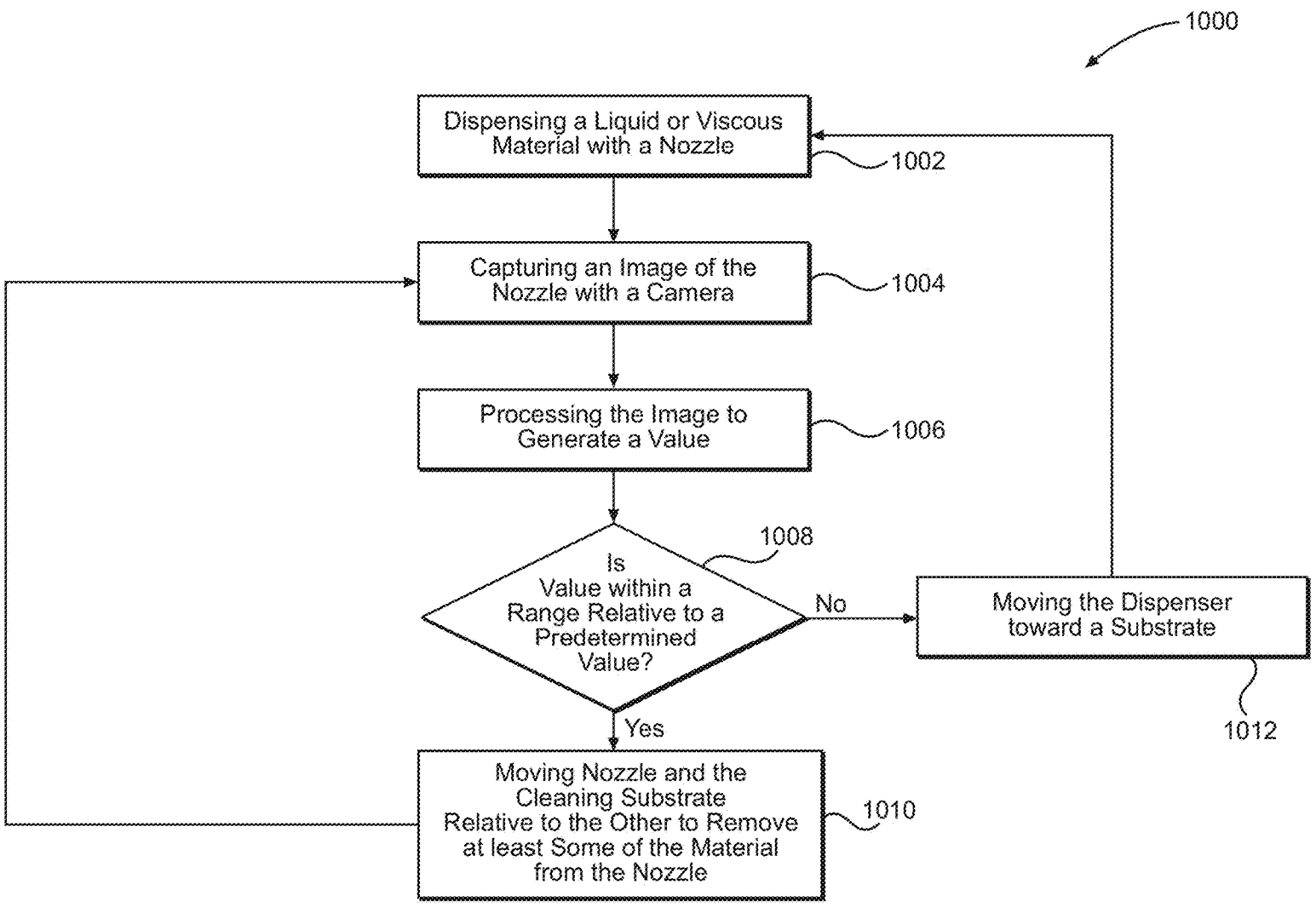
FIG. 10 provides an exemplary flow chart depicting the method of inspecting of the dispensing nozzle of FIGS. 9A-C.

FIG. 7 provides an exemplary flow chart depicting a method 700 of cleaning a nozzle of a dispensing nozzle 16. Method 700 may be performed with the cleaning substrate 68 in either a wet configuration (FIG. 3) or a dry configuration (FIG. 4). Each of the steps of method 700 may be performed based on one or more signals generated by the controller 36. The method 700 may also be performed in conjunction with one or more steps of method 800 (FIG. 8) and/or method 1000 (FIG. 10).

In step 702, the dispensing nozzle 16 may dispense a fluid or viscous material onto a substrate 18. In some embodiment, step 702 may apply a conformal coating onto a printed circuit board. For example, the dispensing nozzle 16 may apply a thin polymeric film conforming to contours of a printed circuit board to protect the board's components. Step 702 may, additionally or alternatively, dispense the fluid or viscous material in a flip chip underfill procedure. The controller 36 may perform step 702 for a predetermined period (e.g., about 1-2 dispensing hours), a predetermined number of cycles, and/or any number of other metrics that estimate the accumulation of material on a surface of the dispensing nozzle 16. After the metric has elapsed, the controller 36 may proceed to step 704 for inspection.

In step 704, the controller 36 may inspect the dispensing nozzle 16. The controller 36 may inspect the dispensing nozzle 16 by actuating the camera 62 and processing an image to generate a value, as illustrated in the flow chart of FIG. 10. However, the inspecting of step 704 may be performed in a number different of other manners.

In step 706, the controller 36 may determine if the dispensing nozzle is sufficiently clean. For example, step 706 may be performed by determining if the value is within a range relative to (e.g., greater than or equal to) a predetermined value indicating a clean dispensing nozzle 16. If the value is within the range indicating a clean dispensing nozzle 16, the controller 36 may return to step 702 to continue dispensing with the dispensing nozzle 16. However, if the value is not within the range indicating a clean dispensing nozzle 16, the controller 36 may proceed to step 708.

In step 708, the controller 36 may open the lid 86 of the cleaning station 60 to expose the cleaning substrate 68 having the plurality of hook structures 70. The opening may be performed by actuating the lid actuator 88 to extend the piston rod 94 from the chamber 96, as depicted in FIG. 3. Step 708 may be omitted in configurations of the cleaning station 60 having a dry cleaning substrate 68.

In step 710, the controller 36 may move at least one of the dispensing nozzle 16 and the cleaning substrate 68 relative to the other to remove a material from the dispensing nozzle 16. For example, the controller 36 may actuate the positioner 25 to move the dispensing nozzle 16 to align with the cleaning substrate 68. The controller 36 may then lower the dispensing nozzle 16 to contact the cleaning substrate 68, and move the dispensing nozzle in one or more directions with respect to the cleaning substrate 68 to remove the material from the dispensing nozzle 16 with the hook structures 70 of the cleaning substrate 68. In a preferred embodiment, the dispensing nozzle 16 may be moved against one or more portions of the cleaning substrate 68 according to the indexing of method 800.

In step 712, the controller 36 may remove the dispensing nozzle 16 from the cleaning substrate 68 the cleaning station 60 and inspect the dispensing nozzle 16. For example, the controller 36 may inspect the dispensing nozzle 16 as discussed in step 704 and illustrated in FIG. 10.

In step 714, the controller 36 may determine if the nozzle is sufficiently clean. If the nozzle is not sufficiently clean ("NO"), the controller 36 may return to step 710 to move at least one of the dispensing nozzle 16 and the cleaning substrate 68 relative to the other to remove additional material from a surface of the dispensing nozzle 16. Based on the nozzle not being sufficiently clean ("NO"), the controller 36 may perform an indexing method to prevent an infinite loop. For example, the controller 36 may update an index and compare the index to a predetermined value to determine whether to return to step 714. The index exceeding the predetermined value may indicate a saturated cleaning substrate 68 or low level of cleaning solvent 76, such that the controller 36 may pause the method 700 and generate an indication (e.g., visual and/or audible) with the user interface 38 to the operator. If the dispensing nozzle 16 is sufficiently clean ("YES"), the controller 36 may proceed to step 716.

In step 716, the controller 36 may close the lid 86 to reduce evaporation of the cleaning solvent 76. The controller 36 may close the lid 86 with the lid actuator 88, by retracting the piston rod 94 into the chamber 96.

In step 718, the controller 36 may dry the dispensing nozzle 16. In some embodiments, the controller 36 may move the dispensing nozzle 16 against the drying substrate 98 to remove the cleaning solvent 76. In some embodiments, the controller 36 may move the dispensing nozzle 16 to the purge station 54 and actuate the vacuum of the purge station 54 to remove the cleaning solvent 76 from the dispensing nozzle 16. After drying, the controller 36 may return the dispensing nozzle 16 to dispensing the fluid or viscous material. Step 718 may be omitted in configurations of the cleaning station 60 having a dry cleaning substrate 68.

In embodiments having a plurality of dispensing nozzles 16, the dispensing nozzles 16 may be inspected and/or cleaned simultaneously or independently depending on the configuration. For example, the dispensing nozzles 16 may be inspected with separate cameras 62, and cleaned using a common positioner 25 and applying the same or separate cleaning substrates 68.

Figure 8:
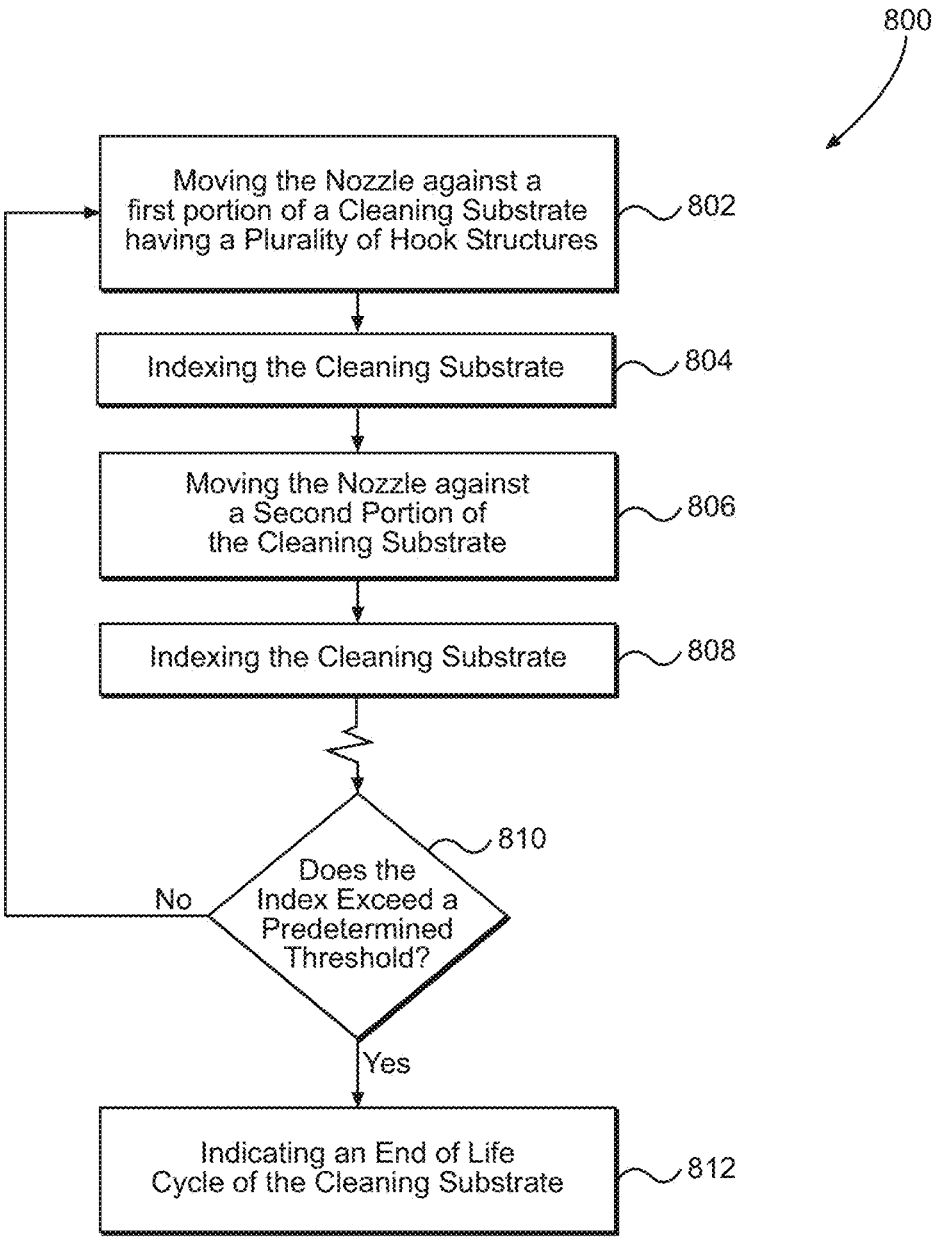
FIG. 8 provides an exemplary flow chart depicting a second method of cleaning a nozzle of a dispenser.

FIG. 8 provides an exemplary flow chart depicting method 800 of cleaning the dispensing nozzle 16. Method 800 may be performed with the cleaning substrate 68 in either a wet configuration (FIG. 3) or a dry configuration (FIG. 4). Each of the steps of method 800 may be performed based on one or more signals generated by the controller 36. It is contemplated that the method 800 may be performed in conjunction with one or more steps of method 700 (FIG. 7) and/or method 1000 (FIG. 10). Method 800 may be performed following the dispensing of a fluid or viscous material by the dispensing nozzle 16 (e.g., step 702), and inspection of the dispensing nozzle 16 (e.g., 704). In method 800, the controller 36 may cycle through different portions of the cleaning substrate 68 during the cleaning process, as discussed below.

In step 802, the controller 36 may move the dispensing nozzle 16 against a first portion of the cleaning substrate 68, as depicted in FIGS. 5A-5C and 6D. The movement of the dispensing nozzle 16 may include at least of one of a linear pattern, a zigzag pattern, a rectangular pattern, a square pattern, an oval pattern, and a circular pattern.

In step 804, the controller 36 may generate or updated an index to indicate the number of the times that the dispensing nozzle 16 has been moved against the cleaning substrate 68 and/or the first portion of the cleaning substrate 68. The controller 36 may then inspect the dispensing nozzle 16 (e.g., step 714) and/or perform additional dispense (e.g., step 702) after step 804.

In step 806, the controller 36 may move the dispensing nozzle 16 against a second portion of the cleaning substrate 68 (as further depicted in FIGS. 4A-C and 6D) after dispensing (e.g., step 702) and inspecting (e.g., step 704), similar to step 802.

In step 808, the controller 36 may iterate the index, similar to step 804. Step 808 may update the same index of step 804 when the nozzle is moved uniformly against each portion of the cleaning substrate 68. This may simplify the process because each of the portions of the cleaning substrate 68 may accumulate material and wear in a similar manner. However, it is also contemplated that the controller 36 may generate separate indexes for each of the portions of the cleaning substrate 68. The steps 810, 812 may be repeated for any number of portions of the cleaning substrate 68. For example, as depicted in FIG. 6D, steps 810, 812 may be repeated for each of the third, fourth, fifth, and sixth portions.

In step 810, the controller 36 may compare the index to a predetermined value. If the index is below the predetermined value ("NO"), the controller 36 may return to step 802 to continue wiping the dispensing nozzle 16 against the same cleaning substrate 68 after dispensing (e.g., step 702) and inspecting (e.g., 704). In some embodiments, the controller 36 may also generate and display on the user interface 38 an indication of a status of the cleaning substrate 68, such as the lifecycle remaining and/or elapsed (e.g., 90% remaining). Therefore, an operator may replace and/or repair the cleaning substrate 68 at a time that is convenient to the flow of production. However, if the index is determined to exceed the predetermined value, the controller 36 may proceed to step 812.

In step 812, the controller 36 may indicate the end of the life cycle of the cleaning substrate 68. For example, the controller 36 may generate and display a visible message to an operator through the user interface 38. It is also contemplated that the controller 36 may, additionally or alternatively, generate an audible indicator, such as an alarm, a bell, and/or a whistle to the operator. The dispensing system 10 may also include multiple cleaning substrates, such that a second cleaning substrate 68 is available following the life cycle of a first cleaning substrate 68.

FIGS. 9A-C illustrate exemplary images captured of the dispensing nozzle 16 to be processed, and FIG. 10 provides an exemplary flow chart depicting a method 1000 of inspecting the dispensing nozzle 16. Method 1000 may be performed with the cleaning substrate 68 in either a wet configuration (FIG. 3) or a dry configuration (FIG. 4). Each of the steps of method 1000 may be performed based on one or more signals generated by the controller 36. It is contemplated that the method 1000 may be performed in conjunction with one or more steps of method 700 (FIG. 7) and/or method 800 (FIG. 8).

In Step 1002, the dispensing nozzle 16 may dispense a fluid or viscous material onto a substrate 18. In some embodiment, step 1002 may apply a conformal coating onto a printed circuit board. For example, in step 1002, the dispensing nozzle 16 may apply a thin polymeric film conforming to contours of a printed circuit board to protect the board's components. Step 1002 may, additionally or alternatively, dispense the fluid or viscous material in a flip chip underfill procedure. The controller 36 may perform step 1002 for a predetermined period (e.g., about 1-2 dispensing hours), a predetermined number of cycles, and/or any number of other metrics that estimate the accumulation of material on an external surface of the dispensing nozzle 16. After the metric has elapsed, the controller 36 may proceed to step 1004 for inspection.

In step 1004, the controller 36 may actuate the camera 62 to capture an image of the dispensing nozzle 16, such as an opening or valve in the dispensing nozzle 16. The controller 36 may actuate the positioner 25 to align the dispensing nozzle 16 with the angled mirror 64, and the z-axis drive may position the dispensing nozzle 16 a predetermined distance away from the platform 48. As depicted in FIG. 9A-C, the images may be captured, by the camera 62, in greyscale to facilitate processing and determining the amount of material accumulated on the dispensing nozzle 16. Alternatively, the images may be captured by the camera 62 in color and then converted to greyscale to facilitate processing.

In step 1006, the controller 36 may process the image. As depicted in FIGS. 9A-C, the controller 36 may capture a predetermined subset of the images depicting the dispensing nozzle 16, and the subset is processed to generate a value based on the pixel intensity of the image. In some embodiment, the controller 36 may process the captured image by comparing one or more pixels of the captured image to one or more corresponding pixels of an image of a clean dispensing nozzle 16 to determine variations in pixel intensity. The pixel intensity variation may indicate an amount of material coated on the dispensing nozzle 16 because portions of the dispensing nozzle 16 coated by a material would be darker than corresponding clean portions of the dispensing nozzle 16. The comparison would provide an array of pixel intensity variations. The controller 36 may then normalize the array to generate the value as a scalar quantity indicative of the variation in pixel intensity of the captured image and the amount of material accumulated on the dispensing nozzle 16.

For example, FIG. 9A depicts a dispensing nozzle 16 that is clean, lacking material accumulation indicated the amount of light pixels. The image of FIG. 9A may be processed by the controller 36 to generate, for example, a high value (e.g., 80-90 on a scale of 0 to 100) to indicate that the nozzle is comparable to an image of a clean dispensing nozzle 16; therefore, the dispensing nozzle 16 of FIG. 9A may continue to dispense without cleaning. FIG. 9B depicts a dispensing nozzle 16 after a few dispensing cycles. There is minimal accumulation of material on the surface the dispensing nozzle 16, but not sufficient to reduce dispensing efficiency. Therefore, the image of FIG. 9B may be processed with the controller 36 to generate a relatively high value (e.g., 60-70 on a scale of 0 to 100). On the other hand, FIG. 9C depicts a dispensing nozzle 16 having substantial material accumulation on the surface due to the number of dark pixels. The accumulation of material may block the opening of the dispensing nozzle 16 and reduce the quality of dispensing to an unacceptable level. Based on the processing of FIG. 9C, the controller 36 may detect the material accumulation when processing the image of FIG. 9C and generate, for example, a relatively low value (e.g., 9-18 on a scale of 0 to 100).

In steps 1008 the controller 36 may determine if the value is within a range relative to a predetermined value indicating the dispensing nozzle 16 being sufficiently clean. For example, the predetermined value may be a predetermined percentage (e.g., 50%) of a clean nozzle, and step 1008 may determine if the value is within the range indicating the nozzle 16 is clean. If the value is determined not to be in the range indicating the nozzle 16 being sufficiently clean ("NO"), the controller 36 may proceed to step 1010. If the value is determined to be in the range ("YES"), the controller 36 may proceed to step 1012.

In step 1010, the controller 36 may move at least one of the dispensing nozzle 16 and the cleaning substrate 68 relative to the other to remove at least some of the material from the dispensing nozzle, as further discussed in at least one of methods 700, 800. For example, the cleaning of step 1012 may be performed with the hook structures 70 of the cleaning substrate 68. After cleaning the dispensing nozzle in step 1012, the controller 36 may return to step 1004, where the camera 62 captures another image of the dispensing nozzle 16. Additional cleaning may be required to make the dispensing nozzle 16 sufficiently clean for dispensing in step 1002.

In step 1012, the controller 36 may move the dispensing nozzle 16 toward the substrate 18. The controller 36 may then proceed to step 1002, where the dispensing nozzle 16 dispenses a fluid or viscous material onto the substrate 18. For example, the dispensing nozzle may dispense a conformal coating onto the substrate 18 (e.g., a printed circuit board).

One or more of software modules incorporating the methods described above can be integrated into a computer system or non-transitory computer-readable media. Moreover, while illustrative embodiments have been described herein, the scope includes any and all embodiments having equivalent elements, modifications, omissions, combinations (e.g., of aspects across various embodiments), adaptations or alterations based on the present disclosure. Further, the steps of the disclosed methods can be modified in any manner, including by reordering steps or inserting or deleting steps.

As such, in a first embodiment, a system for cleaning a nozzle of a dispenser may include a platform and a cleaning substrate supported by the platform. The cleaning substrate may have a plurality of hook structures configured to remove a material from the nozzle.

The system of the first embodiment, wherein the hook structures comprise nylon or polyester. The system of the first embodiment, further comprising a controller configured to generate one or more signals to move at least one of the nozzle and the cleaning substrate relative to the other to remove the material from the nozzle using the plurality of hook structures. The controller is further configured to generate one or more signals to: move the nozzle against a first portion of the cleaning substrate; move the nozzle against a second portion of the cleaning substrate different than the first portion: generate an index based on a number of times the nozzle is moved against the first and second portions of the cleaning substrate; and indicate an end of a lifecycle of the cleaning substrate based on the index being greater than or equal to a predetermined value.

The system of the first embodiment, further comprising: a container supported by the platform and receiving the cleaning substrate; a cleaning solvent within the container and at least partially covering the hook structures; and a lid enclosing the container. The cleaning solvent includes ethoxylated alcohol. The system of the first embodiment, further comprising a level control system configured to: detect a level of the cleaning solvent: compare the detected level to a predetermined threshold; and generate, in response to the detected level being less than the predetermined threshold, a signal to add cleaning solution to the container. The system of the first embodiment, further comprising a support configured to releasably secure the cleaning substrate in the container underneath the lid. The system of the first embodiment, further comprising a drying substrate configured to remove the cleaning solvent from the nozzle. The drying substrate is positioned on an outer surface of the lid. The drying substrate comprises a fabric or a sponge.

The system of the first embodiment, further comprising a camera associated with the platform, the camera being configured to capture an image of the nozzle. The camera is configured to capture an image of an opening in the nozzle. The system of the first embodiment, further comprising a mirror associated with the camera, wherein the mirror is angled relative to the platform and configured to reflect the image of the opening in the nozzle to the camera. The camera and the mirror are positioned underneath the platform. The system of the first embodiment, further comprising a controller configured to generate one or more signals to: dispense a fluid or viscous material from the nozzle, actuate the camera to capture an image of the nozzle, process the image to generate a value, utilize the value to determine if the nozzle should be cleaned, and if the nozzle should be cleaned, move at least one of the nozzle and the cleaning substrate relative to the other to remove material from the nozzle with the hook structures.

The system of the first embodiment, further comprising at least one of a calibration station, a touch sensor station, a purge station, and a weight station.

A second embodiment is directed to a method of cleaning a nozzle of a dispenser. The method may include providing a cleaning substrate having a plurality of hook structures, and moving at least one of the nozzle and the cleaning substrate relative to the other to remove a material from the nozzle.

The method of the second embodiment, wherein moving at least one of the nozzle and the cleaning substrate includes: moving the nozzle relative to the cleaning substrate in a first direction; and moving the nozzle relative to the cleaning substrate in a second direction different from the first direction.

The method of the second embodiment, wherein moving the at least one of the nozzle and the cleaning substrate includes moving the nozzle relative to the cleaning substrate in at least of one of a linear pattern, a zigzag pattern, a rectangular pattern, a square pattern, an oval pattern, and a circular pattern.

The method of the second embodiment, further comprising: opening a lid of a container that receives the cleaning substrate and a cleaning solvent at least partially covering the hook structures: moving the nozzle into contact with the cleaning solvent and the cleaning substrate; removing the nozzle from the container; and closing the lid of the container. The method further comprising moving the nozzle into contact with a drying substrate to remove the cleaning solvent from the nozzle. The method, further comprising: detecting a level of the cleaning solvent; comparing the detected level to a predetermined threshold; and generating a signal to add cleaning solution to the container based on the detected level being less than the predetermined threshold.

The method of the second embodiment, further comprising: moving the nozzle proximate to a camera; capturing, with the camera, an image of the nozzle; processing the image to generate a value based on an amount of material from the nozzle: and determining if the value is within a range relative to a predetermined value, wherein moving the at least one of the nozzle and the cleaning substrate is in response to the value being within the range. The method, further comprising: moving the nozzle proximate to the camera after the moving at least one of the nozzle and the cleaning substrate relative to the other; capturing, with the camera, a second image of the nozzle: processing the second image to generate a second value based on the amount of material on the nozzle; determining if the second value is within the range; and moving at least one of the nozzle and the cleaning substrate relative to the other based on the second value not being within the range. The method, further comprising actuating the nozzle to dispensing a fluid or viscous material if the value is within the range.

The method of the second embodiment, further comprising: moving the nozzle against a first portion of the cleaning substrate; moving the nozzle against a second portion of the cleaning substrate different than the first portion; generating an index based on a number of times the nozzle is moved against the first and second portions of the cleaning substrate: and indicating an end of a lifecycle of the cleaning substrate based on the index being greater than or equal to a predetermined value.

The method of the second embodiment, further comprising: determining a total number of times the nozzle has been moved against the cleaning substrate, determine that the total number of times is greater than or equal to a predetermined total number; and indicating an end of a lifecycle of the cleaning substrate in response to the determination that the total number of times is greater than or equal to the predetermined total number.

The method of the second embodiment, further comprising dispensing a conformal coating onto a printed circuit board. The method of the second embodiment, further comprising moving the nozzle relative to a second nozzle and toward the cleaning substrate. Wherein moving at least one of the nozzle and the cleaning substrate relative to the other includes moving the nozzle with the second nozzle relative to the cleaning substrate.

A third embodiment is directed to a method of inspecting a nozzle of a dispenser. The method may include dispensing a fluid or viscous material with the nozzle, and capturing an image, with a camera, of the nozzle after dispensing. The method may also include processing the image to generate a value based on a pixel intensity of the image, and utilizing the value to determine if the nozzle should be cleaned. The method may further include cleaning the nozzle based on the determination that the nozzle should be cleaned.

The method of the third embodiment, wherein the utilizing the value includes determining if the value is not within a range relative to a predetermined value. The method, further comprising: capturing a second image, with the camera, of the nozzle after cleaning; processing the second image to generate a second value based on the pixel intensity of the image; determining that the second value is within the range; and moving the nozzle toward to substrate to dispensing the fluid or viscous material with the nozzle in response to the second value being within the range.

The method of the third embodiment, wherein cleaning the nozzle includes cleaning the nozzle with a cleaning substrate having a plurality of hook structures. The method of the third embodiment, wherein the image is in greyscale. The method of the third embodiment, wherein processing the image includes: generating an array based on pixel intensity of the image; and normalizing the array to generate the value in a scalar quantity.

The method of the third embodiment, wherein dispensing includes dispensing a conformal coating on a printed circuit board. The method of the third embodiment, wherein capturing the image includes receiving a reflected image from a mirror, the camera being positioned underneath a platform and oriented at an angle relative to a platform.

A fourth embodiment is directed to a dispensing system including a platform and a nozzle of a dispenser moveable relative to the platform. The dispensing system may include a camera positioned underneath the platform and configured to capture an image of the nozzle, and a cleaning substrate supported by the platform and having a plurality of hook structure. The system may further include a controller configured to generate one or more signals to dispense a fluid or viscous material from the nozzle, and actuate the camera to capture an image of the nozzle. The one or more signals may process the image to generate a value, and utilize the value to determine if the nozzle should be cleaned. The one or more signals may further move at least one of the nozzle and the cleaning substrate relative to the other to remove at least some of the fluid or viscous material from the nozzle with the hook structures in response to a determination that the nozzle should be cleaned.

Wherein the controller is configured to utilize the value to determine if the value is not within a range relative to a predetermined value. Wherein the hook structures comprise nylon or polyester. Wherein the controller is further configured to generate one or more signals to: determine a total number of times the nozzle has been moved against the cleaning substrate: determine that the total number of times is greater than or equal to a predetermined total number; and indicate an end of a lifecycle of the cleaning substrate in response to the determination that the total number of times is greater than or equal to the predetermined total number.

The system of the fourth embodiment, further comprising: a container supported by the platform and receiving the cleaning substrate; a cleaning solvent within the container and at least partially covering the hook structures; and a lid enclosing the container. Wherein the cleaning solvent includes ethoxylated alcohol. The system, further comprising a level control system configured to: detect a level of the cleaning solvent; compare the detected level to a predetermined threshold; and generate, in response to the detected level being less than the predetermined threshold, a signal to add cleaning solution to the container. The system further comprising a housing configured to releasably secure the cleaning substrate in the container underneath the lid. The system, further comprising a drying substrate configured to remove the cleaning solvent from the nozzle. Wherein the drying substrate is positioned on an outer surface of the lid. Wherein the drying substrate comprises a fabric or a sponge.

The system of the fourth embodiment, wherein the camera is configured to capture an image of an opening in the nozzle. The system, further comprising a mirror associated with the camera, wherein the mirror is angled relative to the platform and configured to reflect the image of the opening in the nozzle to the camera. The system, wherein the camera and the mirror are positioned underneath the platform.

What is claimed is:

1. A system comprising:

a dispenser having a nozzle;

a platform; and a cleaning substrate supported by the platform, the cleaning substrate having a plurality of hook structures extending from a backing, the plurality of hook structures being configured to remove a material from the nozzle, wherein the hook structures are configured to trap at least some of the material between the hook structures and the backing.

2. The system of claim 1, wherein the hook structures comprise nylon or polyester.

3. A system for cleaning a nozzle of a dispenser, the system comprising a platform;

a cleaning substrate supported by the platform, the cleaning substrate having a plurality of hook structures extending from a backing; and a controller configured to generate one or more signals to move at least one of the nozzle and the cleaning substrate relative to the other of the nozzle and the cleaning substrate to remove a material from the nozzle using the plurality of hook structures.

4. The system of claim 3, wherein the controller is further configured to generate one or more signals to:

move the nozzle against a first portion of the cleaning substrate;

move the nozzle against a second portion of the cleaning substrate different than the first portion;

generate an index based on a number of times the nozzle is moved against the first and second portions of the cleaning substrate; and indicate an end of a lifecycle of the cleaning substrate based on the index being greater than or equal to a predetermined value.

5. The system of claim 1, further comprising:

a container supported by the platform and receiving the cleaning substrate;

a cleaning solvent within the container and at least partially covering the hook structures; and a lid enclosing the container.

6. The system of claim 5, wherein the cleaning solvent includes ethoxylated alcohol.

7. The system of claim 5, further comprising a level control system configured to:

detect a level of the cleaning solvent;

compare the detected level to a predetermined threshold; and generate, in response to the detected level being less than the predetermined threshold, a signal to add cleaning solution to the container.

8. The system of claim 5, further comprising a support configured to releasably secure the cleaning substrate in the container underneath the lid.

9. The system of claim 5, further comprising a drying substrate configured to remove the cleaning solvent from the nozzle.

10. The system of claim 9, wherein the drying substrate is positioned on an outer surface of the lid.

11. The system of claim 9, wherein the drying substrate comprises a fabric or a sponge.

12. A system for cleaning a nozzle of a dispenser, the system comprising:

a platform;

a cleaning substrate supported by the platform, the cleaning substrate having a plurality of hook structures extending from a backing, the plurality of hook structures being configured to remove a material from the nozzle; and a camera associated with the platform, the camera being configured to capture an image of the nozzle.

13. The system of claim 12, wherein the camera is configured to capture an image of an opening in the nozzle.

14. The system of claim 13, further comprising a mirror associated with the camera, wherein the mirror is angled relative to the platform and configured to reflect the image of the opening in the nozzle to the camera.

15. The system of claim 14, wherein the camera and the mirror are positioned underneath the platform.

16. The system of claim 13, further comprising a controller configured to generate one or more signals to:

dispense a fluid or viscous material from the nozzle, actuate the camera to capture an image of the nozzle, process the image to generate a value, utilize the value to determine if the nozzle should be cleaned, and if the nozzle should be cleaned, move at least one of the nozzle and the cleaning substrate relative to the other of the nozzle and the cleaning substrate to remove the material from the nozzle with the hook structures.

17. A system for cleaning a nozzle of a dispenser, the system comprising:

a platform;

a cleaning substrate supported by the platform, the cleaning substrate having a plurality of hook structures extending from a backing; and at least one of a calibration station, a touch sensor station, a purge station, and a weight station.

18. A method of cleaning a nozzle of a dispenser, the method comprising:

providing a cleaning substrate having a plurality of hook structures extending from a backing; and moving at least one of the nozzle and the cleaning substrate relative to the other of the nozzle and the cleaning substrate to remove a material from an exterior surface of the nozzle with the plurality of hook structures.

19. The method of claim 18, wherein moving at least one of the nozzle and the cleaning substrate includes:

moving the nozzle relative to the cleaning substrate in a first direction; and moving the nozzle relative to the cleaning substrate in a second direction different from the first direction.

20. The method of claim 18, wherein moving the at least one of the nozzle and the cleaning substrate includes moving the nozzle relative to the cleaning substrate in at least of one of a linear pattern, a zigzag pattern, a rectangular pattern, a square pattern, an oval pattern, and a circular pattern.

21. The method of claim 18, further comprising:

opening a lid of a container that receives the cleaning substrate and a cleaning solvent at least partially covering the hook structures;

moving the nozzle into contact with the cleaning solvent and the cleaning substrate;

removing the nozzle from the container; and closing the lid of the container.

22. The method of claim 21, further comprising moving the nozzle into contact with a drying substrate to remove the cleaning solvent from the nozzle.

23. The method of claim 21, further comprising:

detecting a level of the cleaning solvent;

comparing the detected level to a predetermined threshold; and generating a signal to add cleaning solution to the container based on the detected level being less than the predetermined threshold.

24. The method of claim 18, further comprising:

moving the nozzle proximate to a camera;

capturing, with the camera, an image of the nozzle;

processing the image to generate a value based on an amount of material from the nozzle; and determining if the value is within a range relative to a predetermined value, wherein moving the at least one of the nozzle and the cleaning substrate is in response to the value being within the range.

25. The method of claim 24, further comprising:

moving the nozzle proximate to the camera after the moving at least one of the nozzle and the cleaning substrate relative to the other of the nozzle and the cleaning substrate;

capturing, with the camera, a second image of the nozzle;

processing the second image to generate a second value based on the amount of material on the nozzle;

determining if the second value is within the range; and moving at least one of the nozzle and the cleaning substrate relative to the other of the nozzle and the cleaning substrate based on the second value not being within the range.

26. The method of claim 24, further comprising actuating the nozzle to dispensing a fluid or viscous material if the value is within the range.

27. The method of claim 18, further comprising:

moving the nozzle against a first portion of the cleaning substrate;

moving the nozzle against a second portion of the cleaning substrate different than the first portion;

generating an index based on a number of times the nozzle is moved against the first and second portions of the cleaning substrate; and indicating an end of a lifecycle of the cleaning substrate based on the index being greater than or equal to a predetermined value.

28. The method of claim 18, further comprising:

determining a total number of times the nozzle has been moved against the cleaning substrate;

determine that the total number of times is greater than or equal to a predetermined total number; and indicating an end of a lifecycle of the cleaning substrate in response to the determination that the total number of times is greater than or equal to the predetermined total number.

29. The method of claim 18, further comprising dispensing a conformal coating onto a printed circuit board.

30. The method of claim 18, further comprising moving the nozzle relative to a second nozzle and toward the cleaning substrate.

31. The method of claim 30, wherein moving at least one of the nozzle and the cleaning substrate relative to the other of the nozzle and the cleaning substrate includes moving the nozzle with the second nozzle relative to the cleaning substrate.

32. The system of claim 1, wherein the hook structures are rigid.

33. The method of claim 18, further comprising trapping the material between the hook structures and the backing.

34. The system of claim 3, further comprising the dispenser having the nozzle.

* * * * *